United States Patent [19]

White

[11] 4,285,643

[45] Aug. 25, 1981

[54] ROTARY FLUID PRESSURE DEVICE

[76] Inventor: Harvey C. White, 3733 Capilano Dr., West Lafayette, Ind. 47906

[21] Appl. No.: 29,019

[22] Filed: Apr. 12, 1979

Related U.S. Application Data

[63] Continuation-in-part of Ser. No. 903,589, May 8, 1978, abandoned.

[51] Int. Cl.[3] ..... F04C 2/10; F04C 15/02

[52] U.S. Cl. ..... 418/61 B; 137/625.24

[58] Field of Search ..... 418/61 B; 251/209; 137/625.13, 625.15, 625.22, 625.23, 625.24

[56] References Cited

U.S. PATENT DOCUMENTS

| | | | |
|---|---|---|---|
| 3,087,436 | 4/1963 | Dettlof et al. | 418/61 B |
| 3,473,438 | 10/1969 | Hansen | 418/61 B |
| 3,516,437 | 6/1970 | Folkerts | 137/625.23 |
| 3,572,983 | 3/1971 | McDermott | 418/61 B |
| 3,863,449 | 2/1975 | White, Jr. | 418/61 B |
| 4,087,215 | 5/1978 | Miller | 418/61 B |
| 4,106,883 | 8/1978 | Hansen et al. | 418/61 B |

FOREIGN PATENT DOCUMENTS

| | | | |
|---|---|---|---|
| 564580 | 11/1932 | Fed. Rep. of Germany | 308/187 |

*Primary Examiner*—Leonard E. Smith

[57] ABSTRACT

A rotary fluid pressure device is described as comprising a housing having fluid inlet and outlet openings and in the housing is a gerotor device having an external stator having internal teeth and a rotor within the stator having external teeth, one less in number than those on the stator. The rotor is eccentrically mounted with respect to the stator so that upon rotation of the rotor, the sealing engagement between the external and internal teeth forms expanding cells on one side of the line of eccentricity and forms contracting cells on the other side of the line. A drive shaft concentric with the rotor has a hollow end within the housing and a solid drive end outside of the housing. A wobble stick drivingly connects the rotor and the shaft and the wobble stick has a pivot point at its inner end connected by a rigid pivot pin with a central recess in the housing axially of the shaft which eliminates axial movement between the drive shaft and the rotor which would otherwise be caused by an uneven end formed by wear on the wobble stick. A manifold, fixed in the housing, provides a double balance pad diametrically opposite each of an inlet passage for conducting inlet fluid to each of the cells between the stator and rotor. Twelve shallow slots are hobbed over six angled holes conducting fluid to the expanding and contracting cells and over six radial holes leading to the balance pads, giving the required accuracy. A novel seal and thrust bearing structure, where the drive shaft exits from the housing, results in good concentricity of the seal carrier and a thrust bearing between the seal carrier and the adjacent end of the housing provides with a flow pumped by the bearing during rotation of the device, which results in a lower temperature on the seal and bearing.

14 Claims, 25 Drawing Figures

ROTARY FLUID PRESSURE DEVICE

This application is a continuation in part of U.S. patent application Ser. No. 903,589 filed May 8, 1978 and entitled "Rotary Fluid Pressure Device", now abandoned.

The object of this invention is to provide a gerotor device having a controlled pivot point which locates the drive link or wobble stick relative to the housing and prevents wear by eliminating the possibility of axial movement between the drive shaft and the housing which might be caused by an uneven end position.

Another object is to provide a gradual balancing by a double balancing pad rather than an abrupt action.

Another object is to provide twelve shallow slots hobbed over six angle holes and six radial holes as part of the flow passageways to and from the changing cells in the gerotor structure, the hobbing providing the required accuracy.

Another object of the invention is to provide a fluid flow loop in the housing, giving a fluid flow through a needle thrust bearing next to a shaft seal, thus increasing the thrust bearing capabilities and the seal and bearing life.

A still further object of the invention is to provide a seal at the exit point of the drive shaft from the housing which includes a generally L-shaped spacer or carrier having one leg against the thrust bearing and the other leg against the shaft thus providing good concentricity of the seal carrier on the shaft.

Other objects and advantages of this invention will be apparent from the accompanying drawings and description and the essential features thereof will be set forth in the appended claims.

Figure 4:
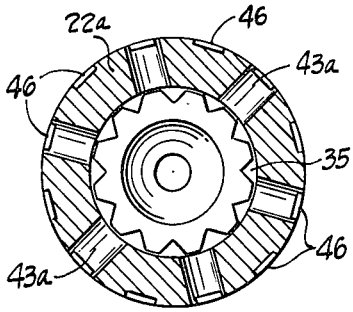
Figure 3:
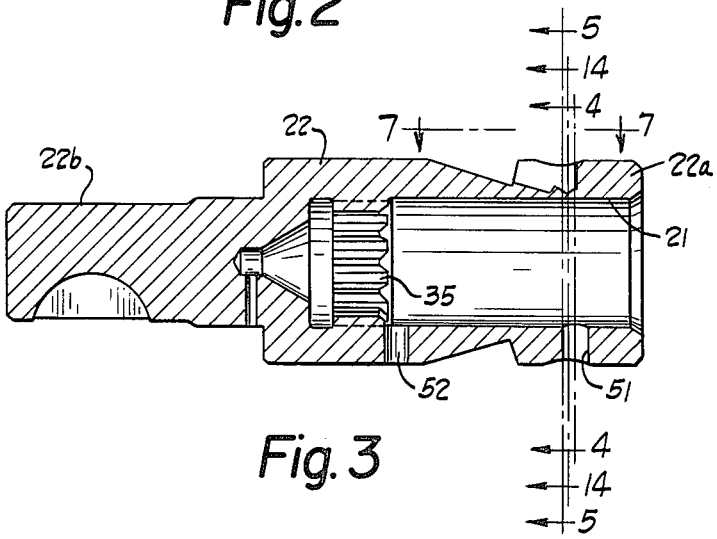
FIG. 3 is a central sectional view of the drive shaft itself turned 180° from position as shown in FIG. 1.
Figure 5:
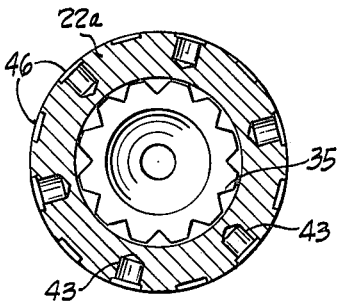

FIGS. 4 and 5 are sectional views taken respectively along the lines 4—4 and 5—5 of FIG. 3.

Figure 6:
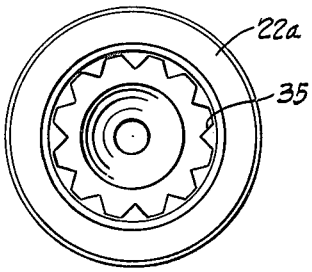

FIG. 6 is an end view of FIG. 3 taken at the right-hand end thereof.

Figure 7:
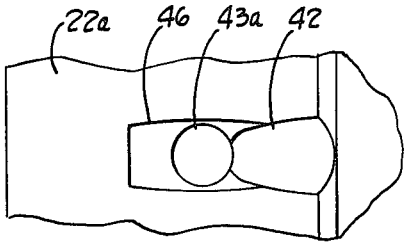

FIG. 7 is a view of one of the hobbed openings taken from the position of the line 7—7 of FIG. 3.

Figure 1:
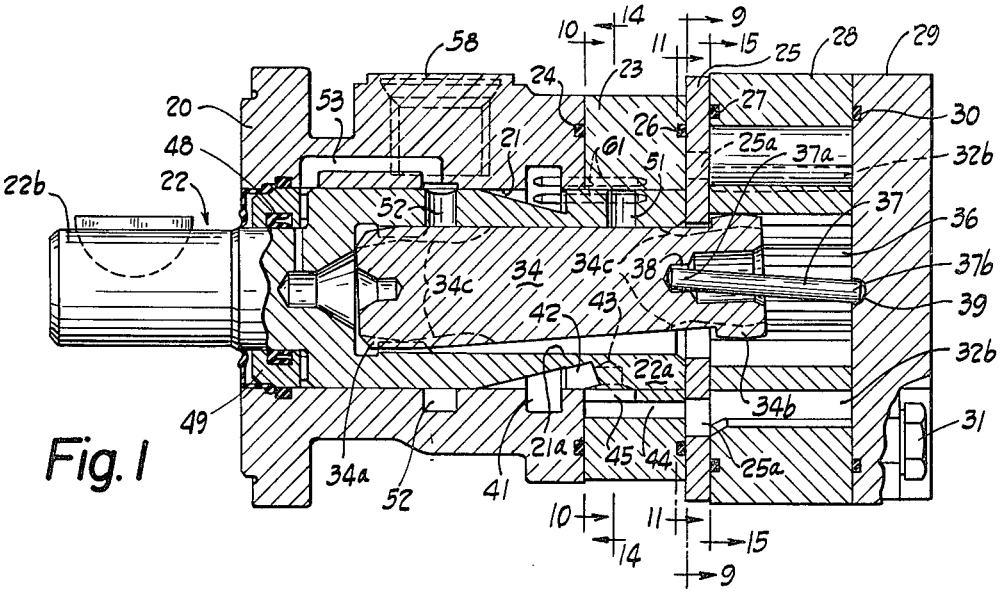
FIG. 1 is a central sectional view of the rotary fluid pressure device taken along the line 1—1 of FIG. 2.
Figure 8:
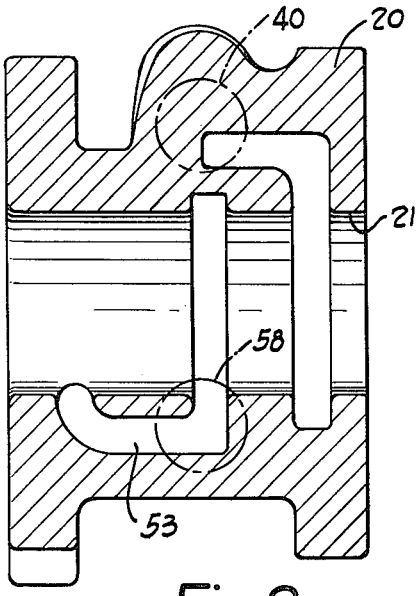

FIG. 8 is a sectional view of the housing of FIG. 1 taken through the bypass shown near the left end of FIG. 1 which connects the thrust bearing with the inlet fluid opening.

Figure 9:
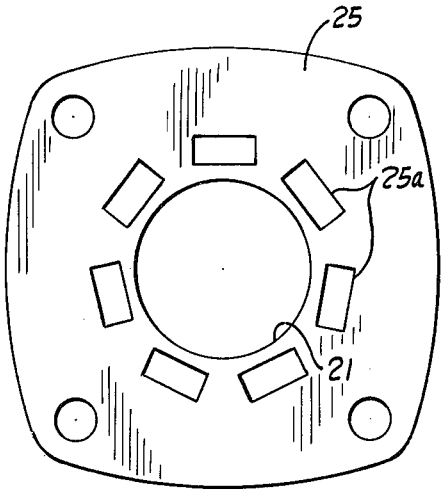

FIG. 9 is a view of the wear plate taken along the line 9—9 of FIG. 1.

Figure 10:
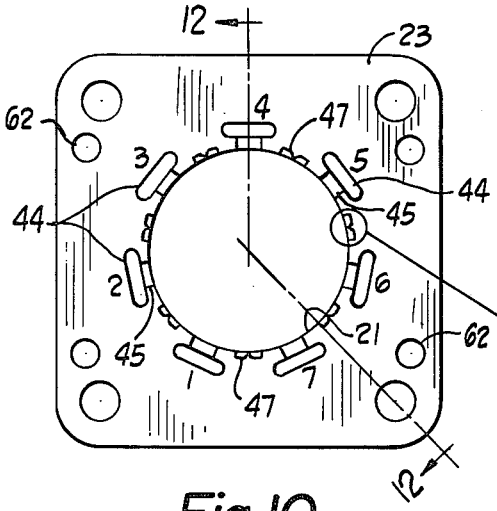

FIG. 10 is a view of the manifold taken on the line 10—10 of FIG. 1.

Figure 10A:
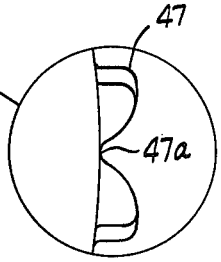

FIG. 10*a* is an enlarged end view taken in the circle of FIG. 10 and being an end view looking along one of the double balancing pads.

Figure 11:
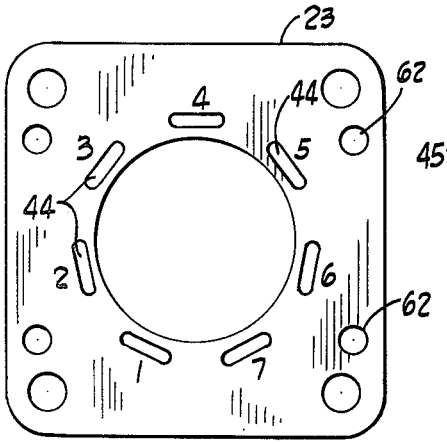

FIG. 11 is a sectional view near the right-hand side of the manifold, taken along the line 11—11 of FIG. 1.

Figure 12:
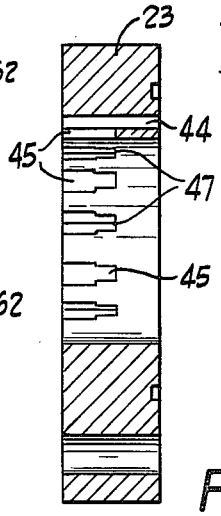

FIG. 12 is a sectional view of the manifold taken along the line 12—12 of FIG. 10.

Figure 13:
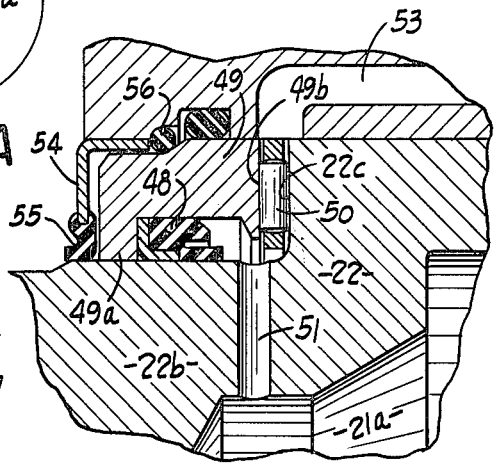

FIG. 13 is an enlarged view of the shaft seal construction shown at the left end of FIG. 1.

Figure 14:
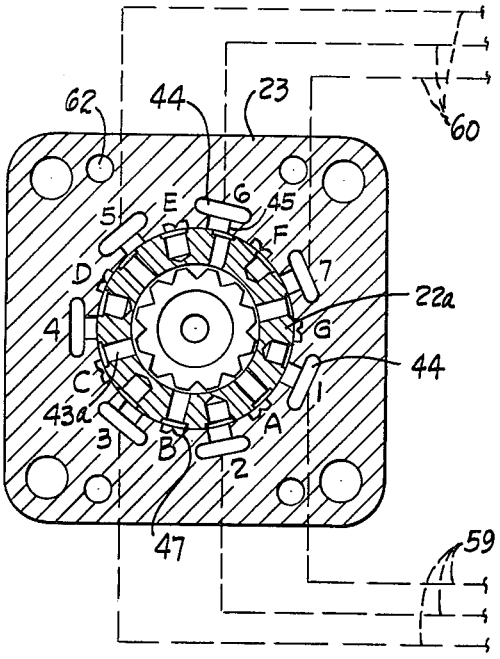

FIG. 14 is a sectional view taken along the line 14—14 of FIG. 1.

Figure 15:
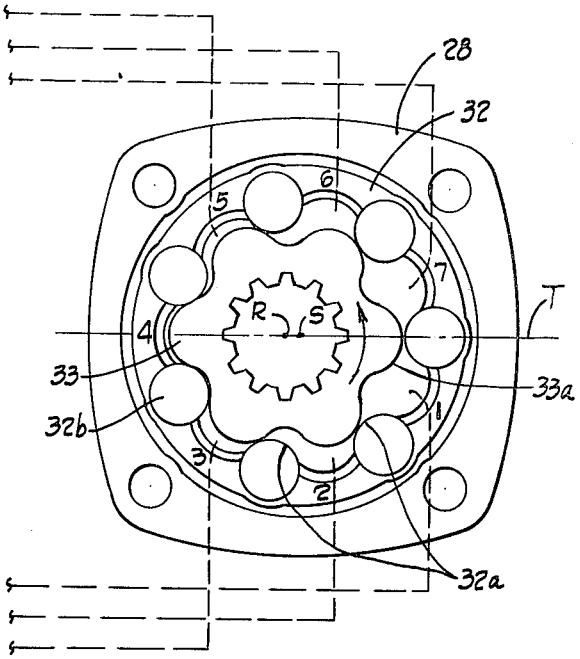

FIG. 15 is a view of the gerotor structure as seen along the line 15—15 of FIG. 1.

Figure 16:
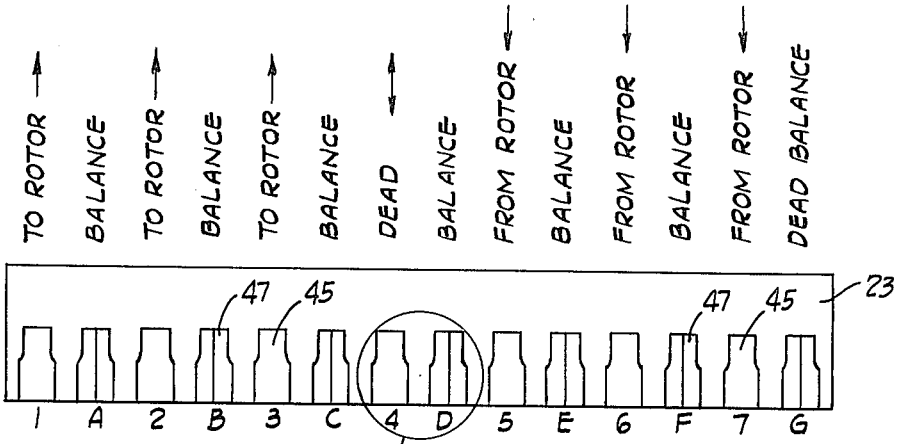

FIG. 16 is a view showing the alternately arranged fluid inlet slots and balance pads of FIG. 12, the same being unrolled and presented in a linear view looking from the inside out.

Figure 16A:
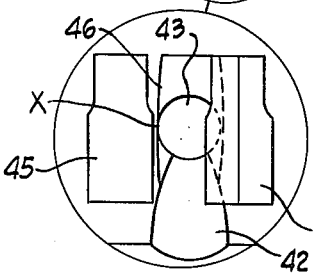

FIG. 16*a* is an enlarged view taken at the circle shown in FIG. 16 and is really a combination of FIGS. 7 and 16.

Figure 17:
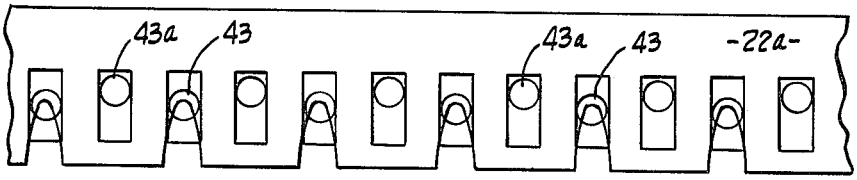

FIG. 17 is a view of the structure toward the right-hand end of the hollow portion of the drive shaft, the same being a view unrolled and presented linearly as from the outside looking in.

Figure 18:
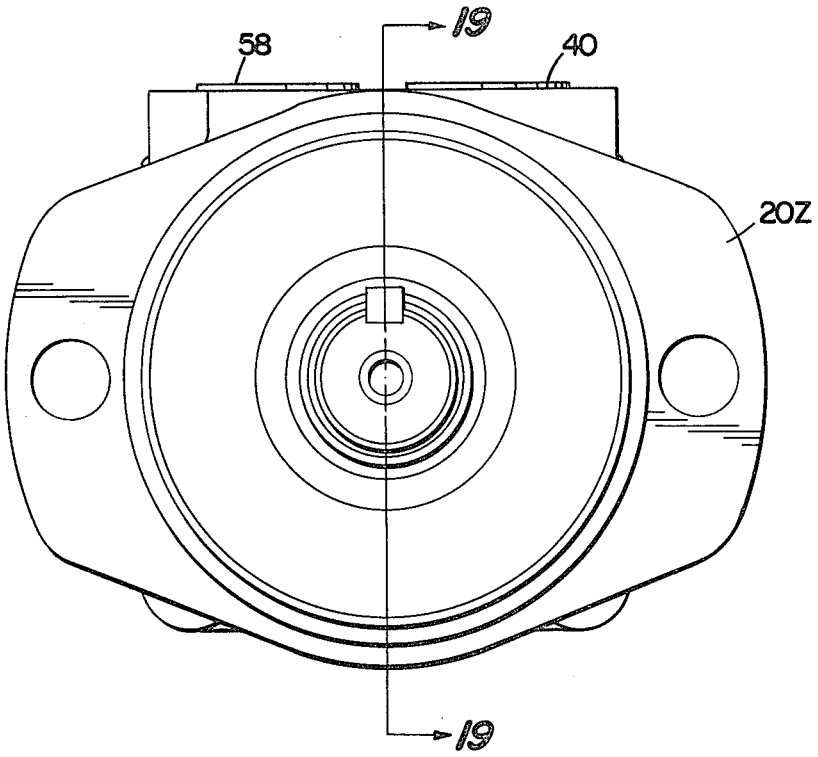

FIG. 18 is a shaft end view of an alternate form of the claimed rotary fluid pressure device of the present invention.

Figure 19:
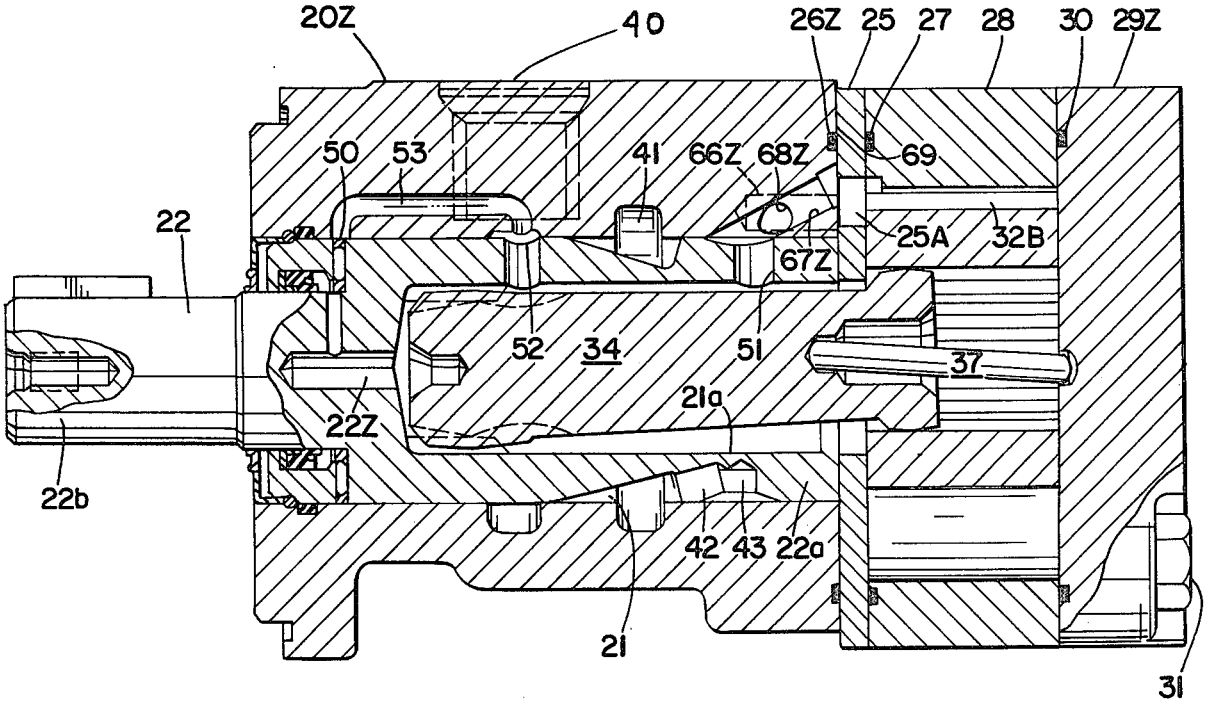

FIG. 19 is a central sectional view of the alternate form taken generally along line 19—19 of FIG. 18.

Figure 20:
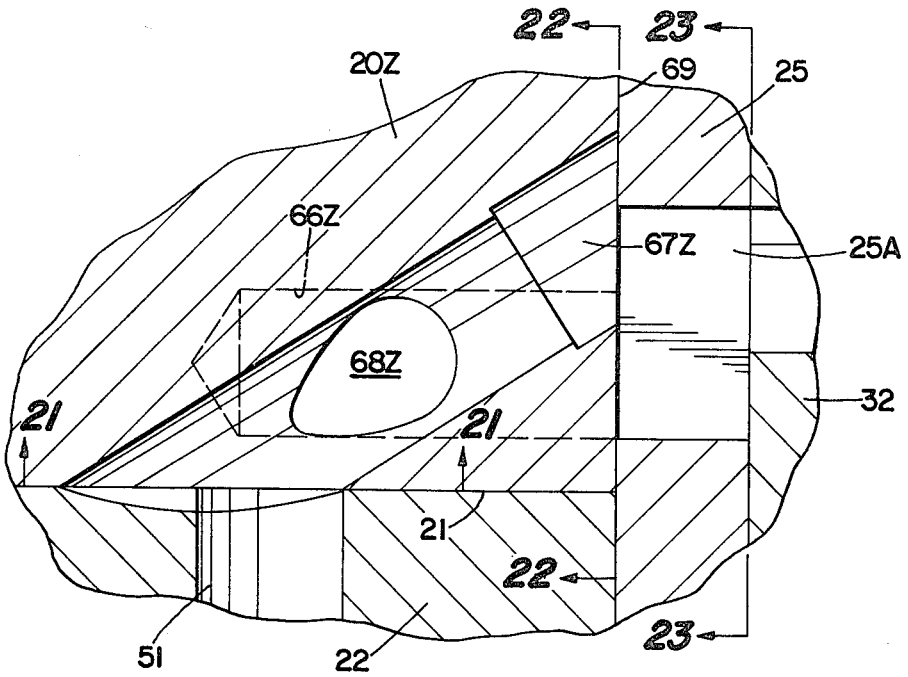

FIG. 20 is an enlarged fragmentary sectional view of the area of a fluid outlet opening shown in FIG. 19.

Figure 21:
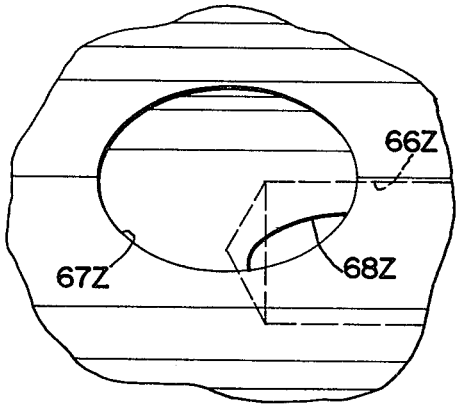

FIG. 21 is an enlarged fragmentary view of a fluid outlet opening taken along line 21—21 of FIG. 20.

Figure 22:
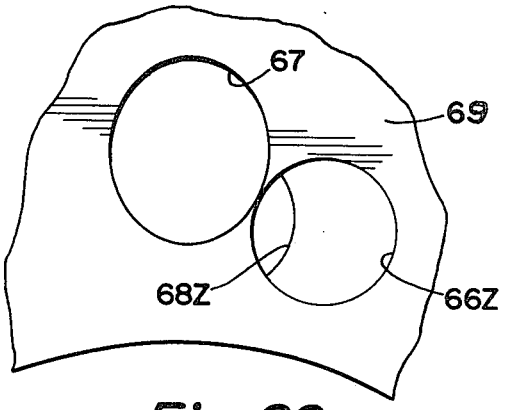

FIG. 22 is an enlarged fragmentary end view of a fluid outlet opening taken along line 22—22 of FIG. 20.

Figure 23:
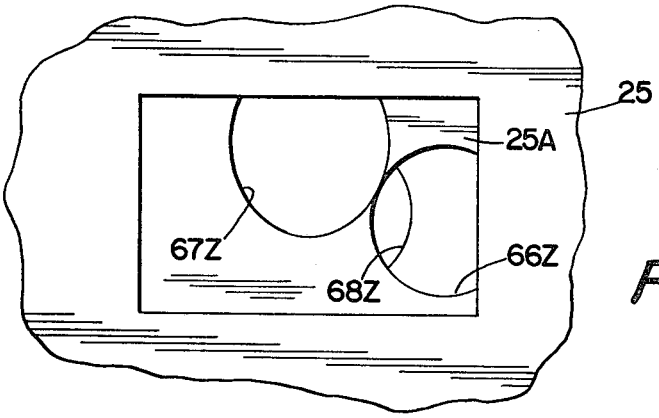

FIG. 23 is an enlarged fragmentary end view of a fluid outlet opening as it appears in combination with a wear plate. The view is taken along the line 23—23 of FIG. 20.

Figure 2:
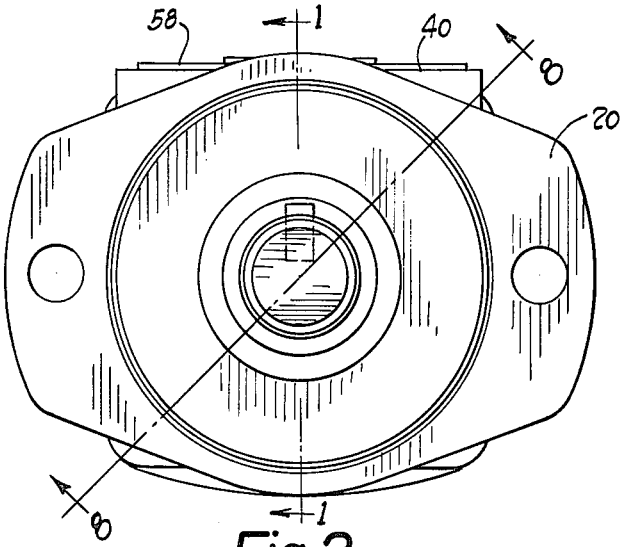
FIG. 2 is an end view of the same taken at the left-hand end of FIG. 1.

Referring now to FIGS. 1, 2 and 3 of the drawings, the rotary fluid pressure device of this invention comprises a housing 20 through which extends longitudinally a through opening 21. Into this opening fits a rotatable drive shaft 22 which has a hollow end 22*a* within the housing and a solid end portion 22*b* extending out the end of the housing. A manifold plate 23 extends crosswise of the housing with the seal between these two parts as shown at 24. Beyond the manifold is a wear plate 25 which is sealed by an annular seal 26 against the manifold and sealed by another annular seal 27 against the gerotor structure 28. The right-hand end of this combined structure as seen in FIG. 1 is closed by an end plate 29 which is sealed by an annular seal 30 against the gerotor structure. Suitable bolts 31 pass through the end plate 29, the gerotor structure 28, the wear plate 25 and the manifold 23 and are driven into threads in the housing 20 to hold all of these parts rigidly together.

To start with the gerotor structure best seen in FIG. 15, the stator 32 is fixed to the plate 28 and has a plurality of inwardly extending teeth 32*a* which match in sealing relation with the outwardly extending teeth 33*a* of the rotor 33 which rotates about its center R while the point R orbits around the stator center S. This action forms expanding cells numbered 5, 6 and 7 on FIG. 15 on one side of the line of eccentricity which runs through the points R and S, while forming contracting cells on the other side of the line of eccentricity numbered 1, 2 and 3 in FIG. 15. It should be understood that the device of this invention will be explained as a pump operation operated by power applied to the drive shaft 22. However, the device may be used as a motor by merely switching the fluid inlet and outlet ports later mentioned so as to drive the shaft 22 by the power developed in the gerotor.

Power is transmitted between the drive shaft 22 and the rotor 33 by means of a drive link or wobble stick 34. Teeth or parallel splines 34*a* on the left-hand end of the wobble stick as seen in FIG. 1 mesh with coacting teeth or splines 35 provided at the inner end of the hollow portion of the drive shaft. At its opposite end, teeth 34*b* on the wobble stick mesh with coacting teeth or splines 36 on the rotor 33. The teeth 34*a* and 34*b* are so formed as to accommodate the orbiting action of the rotor as it passes around the stator. Portions 34*c* are cut away at certain parts of the wobble stick as shown in broken lines in FIG. 1 to enable the flow of the operating pressure fluid past the wobble stick as will later be described.

One of the novel constructions in the present fluid pressure device is the termination of the wobble stick at its right-hand end as seen in FIG. 1 in a position spaced from the end plate 29, and, instead of having the wobble stick impinge directly on the housing of the device, applicant uses a rigid separate pin 37 having one end 37*a* movably rotatable in an axial recess 38 in the adjacent end of the wobble stick, and the other end 37*b* is rotatably mounted on the axis of the drive shaft in a recess 39 in end plate 29. This novel drive prevents wear by eliminating the possibility of axial movement of the wobble stick relative to the drive shaft often caused by an uneven end position, caused by wear, when the wobble stick directly engages the housing. It also provides an inexpensive part, the pin 37, to change when changing gerotor stator 32.

The fluid inlet for this device comprises a fluid inlet opening 40 in the housing communicating through the housing to an annular inlet passageway 41 which opens radially inwardly toward opening 21 in the hollow end 22*a* of the drive shaft. Six separate fluid inlet openings 42 are evenly spaced on the radially exterior face of the hollow end of the drive shaft as seen in FIGS. 1 and 3. Each of said inlets or openings comprises an inclined passageway as shown at 42 communicating at one end with the annular passageway 41 and inclined inwardly toward the hollow drive shaft at an angle of approximately 15°. Within the zone of the manifold the inclined slot communicates with a short bore 43 extending from the outer face of the housing shaft and inwardly for a depth less than the thickness of the shaft wall. To cooperate with each of these separate fluid inlet openings, the manifold 23 has seven evenly spaced through openings 44 closely outside the central through opening 21 in the hollow end of the shaft 22. These seven openings are seen in FIGS. 10 and 11, numbered 1 through 7, and FIG. 10 shows for each of these through openings, a communicating elongated axially extending slot 45 opening radially inwardly to the shaft-surrounding opening 21. Each of said through openings 44 aligns with a through opening 25*a* in the wear plate 25, and thence into communication with one of the openings 32*b* in the stator 32 as seen in FIG. 15 and so into one of the contracting or expanding cells numbered from 1 to 7 in FIG. 15.

One of the novel features of this invention is that the drive shaft 22 has on its outer wall at the hollow end thereof, an axially extending, slightly barrel-shape hobbed shallow recess 46, best seen in FIGS. 7 and 16A extending equally in an axial direction on opposite sides of each of the short bores 43*a* and substantially the width centrally of the bore, and so positioned that, upon relative rotation between the shaft 22 and the manifold 23, as illustrated in FIG. 16A, the bore 43 or 43*a* approaches the hobbed recess 46 tangent to the widest portion of such hobbed recess. In this manner, the flow through each separate inlet occurs smoothly instead of abruptly.

The introduction of inlet fluid entirely on one side of the line of eccentricity in the manifold would cause unbalancing in the manifold unless some opposite balancing effect were supplied. In the present invention this comprises the provision of a balancing pad 47 opening off of said central through opening 21 and directly opposite each of the slots 45 as seen in FIG. 10. Each of these balance pads is separated into two pads by an axially extending central partition 47*a* as seen in FIGS. 10 and 10A. Pressure is applied to each of these pads by a bore 43*a* in the hollow shaft wall evenly spaced between the openings 43 previously described. Each of the balance pad openings 47 in the manifold, as seen in FIG. 12, is substantially the same area as the diametrically opposite slots 45 also seen in FIG. 12. Thus, the manifold is substantially balanced at all times.

A novel seal arrangement is provided at the left-hand end of FIG. 1 where the solid portion 22*b* of the drive shaft exits from the housing 20. This is best seen in FIGS. 1 and 13. An annular seal 48 extends entirely around the solid shaft portion 22*b*. A generally L-shaped seal carrier 49 embraces this seal and has one leg 49*a* flat against the axial dimension of the shaft and having its other end 49*b* with a radial flat face 49*c* toward a radially extending flat shoulder 22*c* on the shaft. A rotatable annular needle thrust bearing 50 is provided between the flat radial surfaces 22*c* and 49*b* and tightly engaging both of such surfaces. The hollow shaft portion 21*a* which is in communication with the bore 21 is provided with a radially extending passageway 51 and communicates outwardly to the radial inner end of the thrust bearing 50. A bypass passageway 53 is provided between the outer end of the radial thrust bearing and the fluid outlet means 52. This bypass is indicated in FIGS. 1 and 13. It results from this construction that, when the device is operating in a rotative manner, the thrust bearing 50 acts as a small pump to pump liquid through the passageway 51 through the thrust bearing and past the seal carrier 49*b* and through the bypass 53 to the fluid outlet 52 and so on out of the machine. The seal carrier 49 is held by the fact 49*b*, against the thrust washer 50, in an exact position normal to the shaft 22 so that the other end of the seal carrier 49*a* is truly concentric with the shaft. Also, the thrust bearing race being an integral part of the seal carrier at 49*b*, causes the oil flow pumped by the bearing to cause a lower temperature of the seal, normally a hot point in the whole device. The dust cover 54 has a seal 55 against the shaft 22 and is held in position by the spiral wire spring 56.

The bypass 53 is best seen in FIGS. 1 and 8. The housing 20 is provided with a core to provide this bypass when this housing is cast.

The flow of the inlet fluid in the rotary fluid pressure device of this invention has been carefully described. The flow outwardly from the gerotor is through one of the openings 32*b*, through a matching passageway 25*a* into wear plate 25, then through a matching through opening 44 in the manifold 23 and then through an opening 51 through the wall of the hollow shaft portion 22*a* and then through the hollow opening 21*a* in the shaft and so into the annular opening 52 which surrounds the shaft opening and which is connected through the housing to the main fluid outlet opening 58.

The purpose of FIGS. 14 and 15 in a combined showing is to illustrate diagrammatically how passages 1, 2 and 3 may be connected by fluid lines 59 to similarly numbered passages 1, 2 and 3 in a gerotor structure while passages 5, 6 and 7 of the gerotor are connected by fluid passageways 60 to the through passages 5, 6 and 7 of the manifold.

The purpose of FIGS. 16, 16A and 17 is to illustrate diagrammatically how the slots 45 and the pad openings occur alternately around the manifold to one looking outwardly from the center of the manifold, and how the hobbed opening 46 approaches tangentially at X to the slots 45 or to the valve's pad openings of 47.

The view of FIG. 17 is from the hollow shaft wall 22*a* looking inwardly to the cooperating openings.

It should be mentioned that this invention requires exact positioning of the manifold 23 relative to the housing 20 and to this end dowel pins 61, seen in FIG. 1, enter some suitable openings 62 seen in FIGS. 10, 11 and 14 so as to very accurately position these two parts.

FIGS. 18 to 23 disclose an alternate form of this rotary fluid pressure invention. Substantially equivalent details will be covered in summary form; only the main points of difference between the two forms will be discussed in detail. Interchangeable parts continue to be numbered as in the first form. Different non-interchangeable parts are labeled Z.

The alternate form of this invention comprises a modified housing 20Z through which extends a through opening 21. Into this opening fits a rotatable drive shaft 22 which has a hollow end 22*a* within the housing and a solid end portion 22*b* extending out of one end of the housing 20Z. A wear plate 25 is sealed by an annular seal 26Z against the other end of the housing 20Z and sealed by another annular seal 27 against the gerotor structure 28. An end plate 29Z is sealed by an annular seal 30 against the gerotor structure 28. Suitable bolts 31 pass through the end plate 29Z, the gerotor structure 28 and the wear plate 25 and are attached by threads in the housing 20Z to hold all of these parts rigidly together. (There is no separate manifold plate 23.)

Power is transmitted between the drive shaft 22 and the gerotor structure 28 by means of a drive link or wobble stick 34. A rigid separate pin 37 prevents axial movement of the wobble stick 34 relative to the drive shaft.

The gerotor structure 28 has a stator 32 and a rotor 33 which rotates about its center R while the center R orbits around the stator center S forming expanding cells on one side of a line of eccentricity and contracting cells on the other side of a line of eccentricity. These cells communicate with fluid inlet means or fluid outlet means through openings 25A in the wear plate 25.

In a point of major difference with the earlier disclosed form, this alternate form has seven pairs of evenly spaced intersecting holes 66Z and 67Z in the other end of the modified housing 20Z forming the fluid passage means between the expanding and contracting gerotor cells and the fluid inlet bores 43 and fluid outlet holes 51, respectively. This is to be contrasted with the earlier disclosed form of this invention wherein the same ends were accomplished in a separate manifold 23 by seven evenly spaced through openings 44 connected to elongated axially extending slots 45.

Each hole 67Z is an angled through hole connecting the end face 69 of the housing with the inner through opening 21. Because hole 67Z intersects these surfaces at an angle, it presents elliptical openings. Hole 66Z is an axially extending hole from the end face 69 located slightly off center and below the end face opening of hole 67Z (See FIG. 22). Both holes 66Z and 67Z at their openings in the end face 69 open through the wear plate 25 into the gerotor cells (See FIG. 23). These holes intersect within the housing at port 68. This port greatly increased the volume of fluid that can pass through the passage system over that which could pass through either hole 66Z or hole 67Z alone. In particular, if the angled through hole 67Z was the only fluid passage conduit between the valving means and the gerotor cells there would be no advantage to the elliptical section it presents at its intersection with both. The limiting factor to fluid flow would be the circular diameter of hole 67Z. However, because it intersects with hole 66Z at port 68 and together they conduct fluid, the size of the relative main passageway is increased complementing the elliptical openings. Fluid can now flow freely between openings without the problems of cross-sectional constriction.

In another point of difference, bores 43 and holes 51 now terminate in shallow elliptical hollows instead of straight sections.

The fluid enters through a main fluid inlet opening 40 in the housing 20Z into a shaft surrounding circular annular passageway 41. The fluid travels from this passageway 41 through openings 42 into short bores 43. These openings 42 and short bores 43 are evenly spaced in pairs on the radially exterior face of the hollow end of the drive shaft. The fluid then travels through these short bores to enter hole 67Z and the expanding gerotor cells.

The fluid exits the contracting cells and hole 67Z through the six holes 51 through the wall of drive shaft's hollow end 22*a*. These holes 51 are evenly spaced on the radially exterior face of the hollow end of the drive shaft. The fluid travels through the hollow opening 21*a* in the shaft and so into the annular opening 52 which surrounds the shaft opening and which is connected through the housing 20Z to the main fluid outlet opening 58.

Although the invention is designed for use as a motor, it is to be understood that it operates as a pump if the fluid inlet and outlet connections are reversed.

Our invention is sturdily constructed of few parts; the wear is carefully designed to be concentrated in four parts easily replaced in the field without major strip-down or even removing the device from allied machinery.

The first alternate form of the invention (FIGS. 1–17) has its advantages in that it is amenable to precision construction on readily available machinery. The second alternate form of the invention is stronger and made of fewer parts. All parts are field replaceable, and most others are interchangeable between forms.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a gerotor structure having a housing, a set of gerotor cells, a valve structure, a gerotor structure and a wobble stick, the improvements comprising a separate manifold, said manifold fixed to the housing, the manifold containing a set of fluid passages to selectively communicate the set of gerotor cells to the valve structure, a rigid separate pin and said pin having its opposite ends engaging between the gerotor structure end of the wobble stick and the housing.

2. In a fluid pressure device having a housing, a drive shaft, a gerotor structure, a wobble stick drivedly connecting the drive shaft to the gerotor structure and fluid inlet and outlet means, the improvement of a wobble stick locating device comprising a rigid separate pin and said pin having its opposite ends engaging between the gerotor structure end of the wobble stock and the housing.

3. The structure of claim 2 characterized by the addition of a cavity in the housing and a second cavity in the gerotor structure end of the wobble stick and said pin having its opposite ends engaging between the gerotor structure end of the wobble stick in said second cavity and the housing in said cavity.

4. A rotary fluid pressure device comprising a housing, fluid inlet and outlet means in said housing, an internally toothed member, a coacting externally toothed member having one less tooth than said internally toothed member and having its axis positioned eccentrically relative to the axis of said internally toothed member, one of said members having orbital movement about the axis of said other member while forming expanding and contracting cells between said members, a drive shaft rotatably mounted in said housing and having a hollow end inside said housing and a drive connection as its other end, a rigid elongated wobble stick in said hollow end of said shaft, the ends of said wobble stick having respectively a first rotatable keyed driving connection with said shaft and a second rotatable keyed connection with said orbiting member and valve structure, passages responsive to said rotatable movement for communicating at all times part of said cells with one only of said fluid inlet and outlet means while communicating other of said cells with the other of said fluid inlet and outlet means, and a wobble stick locating device comprising a rigid separate pin having its opposite ends engaging between said orbiting end of said wobble stick and said housing.

5. A rotary fluid pressure device as defined in claim 4 wherein said internally toothed member is a stator fixed in said housing, said externally toothed member is a rotor, said rotor having rotational movement about its axis and having orbital movement about said stator axis, the teeth of said rotor and stator intermeshing during said orbiting movement in substantially sealing engagement to form said expanding cells on one side of the line of eccentricity and to form said contracting cells on the other side of said line.

6. In a rotary fluid pressure device having a housing, fluid inlet and outlet means in the housing, an internally toothed member, a coacting externally toothed member having a lesser number of teeth than the internally toothed member and having its axis positioned eccentrically relative to the axis of the internally toothed member, one of the members being rotatable and having orbital movement about the axis of the other member while forming expanding and contracting cells between the members, a rigid elongated wobble stick having first and second end portions, means connected to the first end portion of the wobble stick for rotating the same, means connecting the second end portion of the wobble stick to the member having rotatable and orbital movement, and valve structure and passages positioned in the housing for communicating some of the cells with the fluid inlet means while communicating other of the cells with the fluid outlet means; the improvement of a wobble stick locating device comprising a rigid separate pin having first and second end portions, said first end portion of said pin engaging the second end portion of the wobble stick and said second end portion of said pin engaging the housing.

7. A rotary fluid pressure device as claimed in claim 6 wherein the internally toothed member is fixed and the externally toothed member is rotatable and has orbital movement.

8. The structure of claim 6 characterized by the addition of a cavity in the housing and a second cavity in the second end portion of the wobble stick, said first end portion of said pin engaging the second end portion of the wobble stick in said second cavity and said second end portion of said pin engaging the housing in said cavity.

9. A gerotor pressure device including in combination a plurality of stationary valve passages, each of said valve passages comprising a first hole and second hole, said first hole being a through bore, said second hole being a partial through bore and said first hole and said second hole intersecting at an acute angle to increase the relative apparent cross section of either hole and to increase the volume of fluid able to flow through said holes.

10. A gerotor pressure device including in combination a plurality of stationary valve passages, each of said valve passages comprising a pair of holes, one of said pair of holes being a through hole, the other of said pair of holes being a partial through bore and said pair of holes intersecting at an acute angle to increase the relative apparent cross section of either of said pair of holes and increase the volume of fluid able to flow through said holes.

11. In a fluid pressure device having a gerotor structure, a housing having an end face to which the gerotor structure is attached, the housing having a bore oriented normal to the end face and fluid inlet and outlet means in the housing including rotary valving means; the improvement of valve passage means comprising a plurality of pairs of holes in the housing, one of each of said pairs of holes being a through hole, said hole having two end openings, said first end opening of said one hole being located in the end face of the housing, said second end opening of said one hole being located in the bore of the housing, said other hole of each of said pairs of holes being a partial through bore, said other hole having one end opening, said one end opening of said other hole being located in the end face of the housing and said one hole intersecting said other hole in the housing thereby increasing the relative apparent cross section of either of each of said pair of holes and thereby increasing the volume of fluid able to flow through said holes.

12. In a fluid pressure device having a gerotor structure, a housing having an end face to which the gerotor structure is attached, the housing having a bore oriented normal to the end face and fluid inlet and outlet means in the housing including rotary valving means; the improvement of stationary valve passage means comprising a plurality of pairs of holes in the housing, said plurality of pairs of holes equally circumferentially spaced around the bore of the housing, one of each of said pairs of holes being a through hole, said one hole having two end openings, said first end opening of said one hole being located in the end face of the housing, said second end opening of said one hole being located in the bore of the housing, the other hole of each of said pairs of holes being a partial through bore, said other hole having one end opening, said one end opening of said other hole being located in the end face of the housing, said one end opening of said other hole in the end face of said housing being adjacent to said first end opening of said one hole in the end face of the housing, said other hole being oriented normal with respect to the end face of said housing and said other hole intersecting said one hole in the housing at an acute angle thereby increasing the relative apparent cross section of either of each of said pair of holes and increasing the volume of fluid able to flow through said holes.

13. In a fluid pressure device having a gerotor structure, a housing having an end face to which the gerotor structure is attached, the housing having a bore oriented normal to the end face, an end plate on the gerotor structure, a drive shaft, a thrust bearing having an inner and outer circumference, an end seal adjacent to the thrust bearing, a wobble stick drivedly connecting the drive shaft to the gerotor structure and fluid inlet and outlet means; the improvement comprising a rigid pin, said pin having two end portions, a pocket in the wobble stick at its gerotor structure end, a pocket in the end plate, the first end portion of said rigid pin engaging said pocket in the wobble stick and the second end portion of said rigid pin engaging said pocket in the end plate to axially locate the wobble stick, fluid inlet means to the inner circumference of the thrust bearing and fluid outlet means from the outer circumference of the thrust bearing to allow the bearing to pump fluid to lubricate and cool itself and the adjacent end seal, a plurality of pairs of holes in the housing, one of each of said pairs of holes being a through hole, said one hole being extended between the housing's end face and the bore, the other of each of said pairs of holes being a partial through bore, said other hole oriented normal to said end face and said one hole intersecting said other hole in the housing to increase the apparent cross section of either, fluid conduit means at the position where the drive shaft drivedly connects with the wobble stick and fluid outlet means at the position where the drive shaft drivedly connects with the wobble stick allowing fluid to pass over this connection to cool and lubricate it.

14. In a fluid pressure device having a gerotor structure, a housing having an end face to which the gerotor structure is attached, the housing having a bore oriented normal to the end face and fluid inlet and outlet means in the housing including rotary valving means; the improvement of stationary valve passage means comprising a plurality of first and second holes in the housing, said plurality of first and second holes equally circumferentially spaced around the bore of the housing, said first hole being a through hole, said first hole having two end openings, said first end opening of said first hole being located in the end face of the housing, said second end opening of said first hole being located in the bore of the housing, said second hole being a partial through bore, said second hole having one end opening, said one end opening of said second hole being located in the end face of the housing, said one end opening of said second hole in the end face of said housing being adjacent to said first end opening of said first hole in the end face of the housing, said second hole being oriented normal with respect to the end face of said housing and said second hole intersecting said first hole in the housing at an acute angle thereby increasing the relative apparent cross section of either of said holes and increasing the volume of fluid able to flow through said holes.

* * * * *